United States Patent [19]

Toda et al.

[11] Patent Number: 4,855,549

[45] Date of Patent: Aug. 8, 1989

[54] CIRCUIT BREAKER

[75] Inventors: Haruhisa Toda; Shiroo Murata, both of Fukuyama, Japan

[73] Assignee: Mitsubishi Denki Kabushiki Kaisha, Tokyo, Japan

[21] Appl. No.: 271,486

[22] Filed: Nov. 15, 1988

Related U.S. Application Data

[63] Continuation of Ser. No. 76,817, Jul. 23, 1987, abandoned.

[30] Foreign Application Priority Data

| | | | |
|---|---|---|---|
| Jul. 24, 1986 | [JP] | Japan | 61-114682 |
| Jul. 24, 1986 | [JP] | Japan | 61-114683 |
| Jul. 24, 1986 | [JP] | Japan | 61-114684 |
| Jul. 24, 1986 | [JP] | Japan | 61-114685 |
| Aug. 4, 1986 | [JP] | Japan | 61-120174 |

[51] Int. Cl.[4] ..... H01H 77/06

[52] U.S. Cl. ..... 200/401; 200/288; 335/16

[58] Field of Search ..... 200/288, 401; 335/16, 335/195

[56] References Cited

U.S. PATENT DOCUMENTS

| | | | |
|---|---|---|---|
| 3,003,046 | 10/1961 | De Torre | 200/153 G |
| 3,005,073 | 10/1961 | Reiss et al. | 335/16 |
| 3,492,609 | 1/1970 | Murai et al. | 335/16 |
| 4,227,161 | 10/1980 | Yamat et al. | 335/16 |
| 4,339,642 | 7/1982 | Seymour et al. | 200/153 G |
| 4,574,170 | 3/1986 | Abe et al. | 200/153 G |
| 4,588,878 | 5/1986 | Klein et al. | 200/153 G |
| 4,600,908 | 7/1986 | Uchida et al. | 335/16 |
| 4,608,545 | 8/1986 | Kralik | 335/195 |

*Primary Examiner*—Renee S. Luebke

*Attorney, Agent, or Firm*—Lowe, Price, LeBlanc, Becker & Shur

[57] ABSTRACT

A circuit breaker has a stationary contact arm (2) having a stationary contact (3), a first contact arm (107) having a contact (6) for contacting the stationary contact (3) and an extended terminal portion (107) for connecting a flexible wire (8) and a second contact arm (110) for pivoting the first contact arm, and a third contact arm (110*a*) that pivots about a common axis of the second contact arm and is provided with a flattened U-shaped aperture (114) thereon, and which is connected with an oblong aperture of the second contact arm by a connecting member (16).

4 Claims, 15 Drawing Sheets

CIRCUIT BREAKER

This application is a continuation of application Ser. No. 076,817, filed July 23, 1987, now abandoned.

FIELD OF THE INVENTION AND RELATED ART STATEMENT

1. Field of the Invention

The present invention relates generally to a circuit breaker and, more particularly, to a circuit breaker comprising a lower contact arm having a lower contact fixed thereon and an upper contact arm having an upper contact which is pivotally mounted so as to contact the lower contact at the upper contact.

2. Description of the Related Art

FIG. 1 shows a side sectional view of the circuit breaker in the prior art. Referring to FIG. 1, a molded insulating housing 1 enclosing the circuit breaker is composed of a base 1*a* and a cover 1*b*. A lower contact arm 2 is mounted on the base 1*a* and a lower contact 3 is fixed on the lower contact arm 2. An upper contact 6 is fixed on a first upper contact arm 7, and the first upper contact arm 7 is pivotally mounted to a second contact arm 10 by a pin 11. The second contact arm 10 pivots about a pin 12. An automatic trip mechanism 4 is disposed at a right portion of the housing 1, and a connecting member 5 from the automatic trip mechanism 4 is disposed on the right end of the housing 1, and another connecting member 9 from the automatic trip mechanism 4 is disposed on a lower portion thereof. The first upper contact arm 7 and the connecting member 9 are connected with a flexible wire 8. The second upper contact arm 10 is provided with an oblong aperture 15 with rounded ends on a center portion, and which major axis is along the length of the second upper contact arm 10. A third upper contact arm 10*a* also pivots about the pin 12 and a J-shaped aperture 14 is provided on the left portion thereof. A pin 16 is inserted in both the J-shaped aperture 14 and the oblong aperture 15, and an extension spring 17 is connected between the pins 11 and 16. A compression spring 18 is provided between the first upper contact arm 7 and an end portion 10*b* of the second upper contact arm 10. In the circuit breaker for practical use, three sets of the mechanism which is composed by the lower contact arm 2, the first upper contact arm 7, the second upper contact arm 10 and the third upper contact arm 10*a* are assembled for each of three phases of an electric line. The respective third upper contact arms 10*a* are linked by a crossbar 13, and when the third upper contact arm 10*a* in the center portion is driven by an operation mechanism 20 which is operated by an operation handle 19, the other third upper contact arms 10*a* are driven through the crossbar 13. An extinguishing device 23 is disposed on a left portion of the housing 1.

Operation of the circuit breaker is elucidated hereinafter. When the circuit breaker is closed as shown in FIG. 1, a current flows through the connecting member 5, the automatic trip mechanism 4, the flexible wire 8, the first upper contact arm 7, the upper contact 6, the lower contact 3 and the lower contact arm 2.

When the operation handle 19 is moved to the direction as shown by the arrow 24 in FIG. 2, the third upper contact arm 10*a* is lifted up through the operation mechanism 20 which is linked by a pin 22. Consequently, the second upper contact arm 10 and the first upper contact arm 7 are lifted up by the pin 16 which is inserted in both the J-shaped aperture 14 and the oblong aperture 15, and the upper contact 6 is separated from the lower contact 3 as shown in FIG. 3. In the above-mentioned operation, the second upper contact arm 10 is lifted up by the pin 16 which pushes an inner wall 14*a* of the J-shaped aperture 14. Then, the second upper contact arm 10 touches a stopper pin 21 at an end portion 10*b* and its movement, is thus limited.

When an overload current flows through the circuit breaker, the automatic trip mechanism 4 drives the operation mechanism 20 and the third upper contact arm 10*a*, the second upper contact arm 10 and the first upper contact arm 7 are lifted up as shown in FIG. 4. As a result, the upper contact 6 is separated from the lower contact 3. This state of the circuit breaker is called a "trip state". In the above-mentioned operation, the pin 16 falls into a lower round end 14*a* of the J-shaped aperture 14, and the second upper contact arm 10 is lifted up with the third upper contact arm 10*a* by the pin 16. Then, the upward movement of the second upper contact arm 10 is interrupted by the pin 21.

When a large current such as a shortcircuit current flows in the circuit breaker, a magnetic force is generated between the lower contact arm 2 and the first upper contact arm 7 so as to lift up the first upper contact arm 7. The second upper contact arm 10 pushes the pin 16 at the inner wall 15*a* of the oblong aperture 15. Consequently, the pin 16 escapes from the lower round end 14*a*, and runs upward along the J-shaped aperture 14. Finally the pin 16 reaches the upper round end 14*b* of the J-shaped aperture 14. As a result, the first upper contact arm 7 and the second upper contact arm 10 move to the upper position, and only the third upper contact arm 10*a* stays at the lower position as shown in FIG. 5, since the operation mechanism 20 is not operated. The strength of the extension spring 17 is adjusted so that the pin 16 will move from the lower round end 14*a* of the J-shaped aperture 14 when a predetermined current flows. In the above-mentioned operation, movement of the second upper contact arm 10 is interrupted by the upper round end 14*b* of the J-shaped aperture 14.

Generally, action of the first upper contact arm 7 being driven by the magnetic force is faster than action by the operation mechanism 20. Therefore, the current limiting characteristic in the shortcircuit operation is superior. In the above-mentioned operation, after separation of the upper contact 6 from the lower contact 3, the automatic trip mechanism 4 drives the operation mechanism 20, and the third upper contact arm 10*a* is lifted up. Hence, the pin 16 relatively falls again in the lower round end 14*a* of the J-shaped aperture 14 as shown in FIG. 4. The above-mentioned operation is referred to as "reset" of the second upper contact arm 10. In the above-mentioned operation, when the second upper contact arm 10 is moved upward and the pin 16 is also moved upward along the J-shaped aperture 14, after arrival of the pin 16 at the upper round end 14*b* of the J-shaped aperture 14, the pin 16 rebounds from the upper round end 14*b* and returns in the direction as shown by arrow 27 in FIG. 6. Thereby, the second upper contact arm 10 is pushed in the direction indicated by the arrow 27 and goes downward, and the upper contact 6 of the first upper contact arm 7 approaches to the lower contact 3. Hence, an interrupting characteristic of the circuit breaker is diminished.

Furthermore, melted substances which are produced by electric arc in the opening process of the lower contact 3 and the upper contact 6 adhere at the inner wall 14*d* of the J-shaped aperture 14 because the inner wall 14*d* faces the extinguishing device 23 as shown in FIG. 6. As a result, when this happens, the pin 16 can not smoothly travel in the J-shaped aperture 14 and movement of the second upper contact arm 10 is liable to be obstructed, and thereby the interrupting characteristic of the circuit breaker is diminished.

Moreover, when the current flows via the first upper contact arm 7, the upper contact 6, the lower contact 3 and the lower contact arm 2, the directions of the current in the U-shaped portion 2*a* and the first upper contact arm 7 are the reverse of each other, since the lower contact arm 2 has a U-shaped portion 2*a* as shown in FIG. 2. Hence, a repulsion is generated between them by magnetic force. The first upper contact arm 7 is then liable to be lifted up due to the repulsion when a large current flows. In order to resolve the problem, a heavy compression spring 18 is required to push down the first upper contact arm 7. However, the heavy compression spring is large in size and results in an increase in the size of the circuit breaker.

OBJECT AND SUMMARY OF THE INVENTION

An object of the present invention is to provide a circuit breaker having an improved interrupting characteristic.

Another object of the present invention is to provide a circuit breaker having an improved current limiting characteristic.

The circuit breaker in accordance with the present invention comprises:

a stationary contact arm having a first contact, a movable contact arm having a second contact for contacting the first contact, a first arm mounting pivotally the movable contact arm, being provided with an oblong aperture on a central portion thereof, and mounted pivotally, a second arm having a flattened U-shaped aperture on one end portion and mounted pivotally at the other end, a pin inserted to slidably engage in the oblong aperture and the flattened U-shaped aperture, a spring for energizing the pin, and operation means for moving a third contact arm in operation of the circuit breaker.

DESCRIPTION OF THE PREFERRED EMBODIMENT

Figure 1:
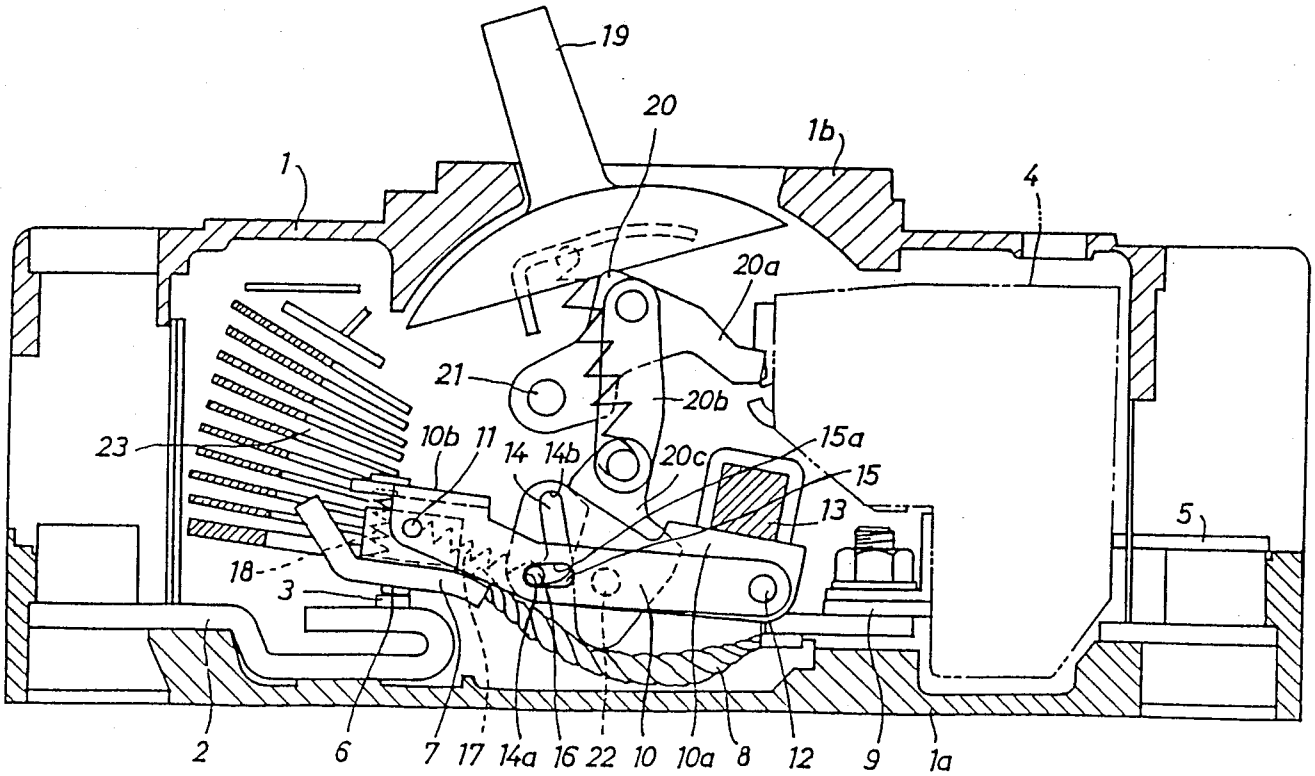
FIG.1 (Prior Art)
FIG. 1 is a side sectional view of a circuit breaker in the prior art.
Figure 2:
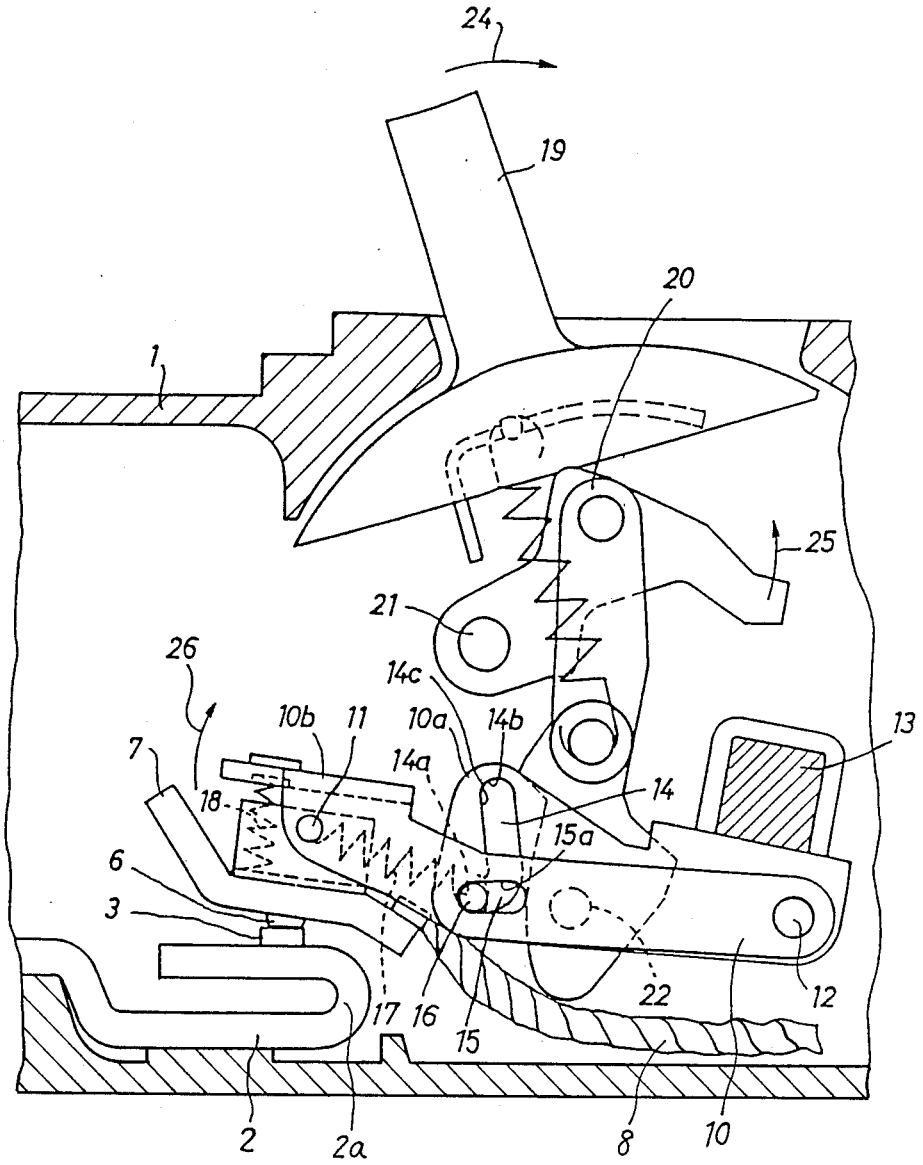
FIG. 2 (Prior Art)
FIG. 2 is a side view showing the main portion of the circuit breaker of FIG. 1 in closed state.
Figure 3:
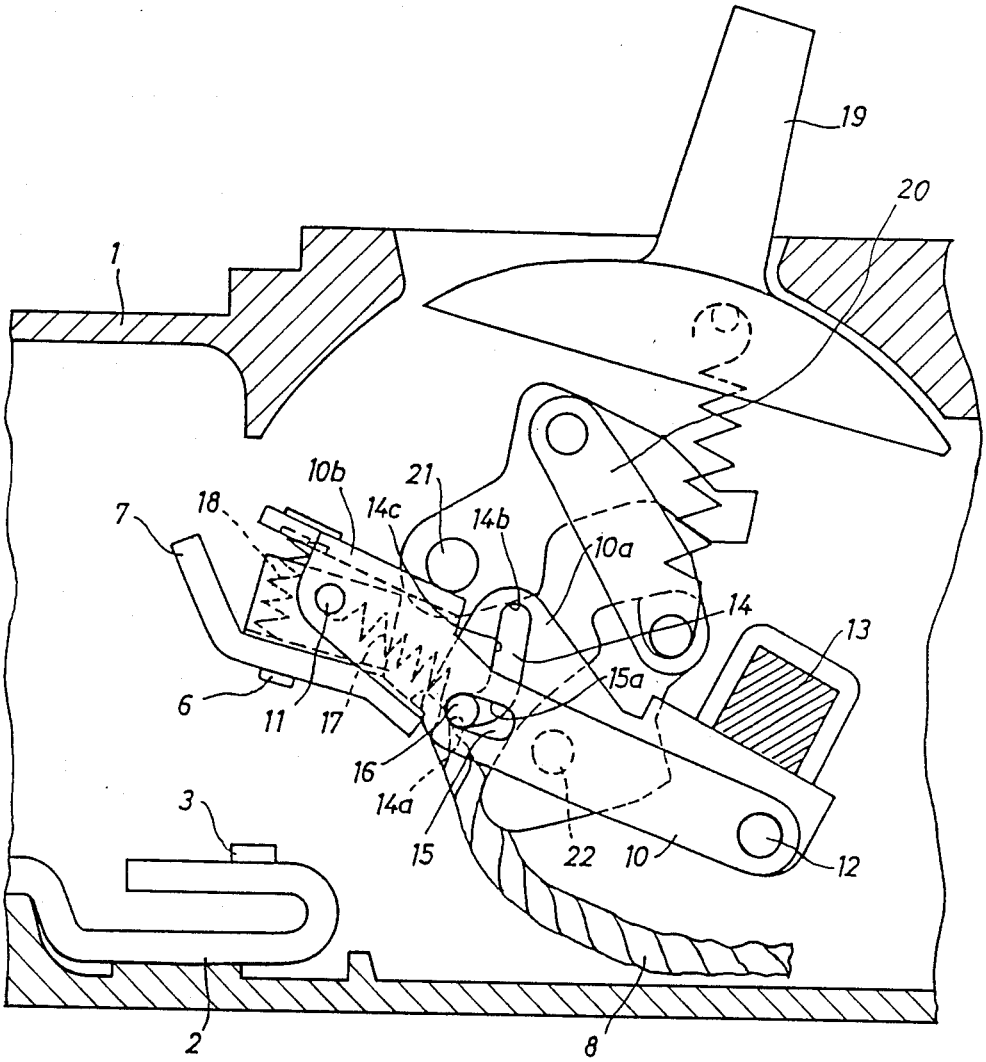
FIG.3 (Prior Art)
FIG. 3 is a side view showing the main portion of the circuit breaker of FIG. 1 in open state.
Figure 4:
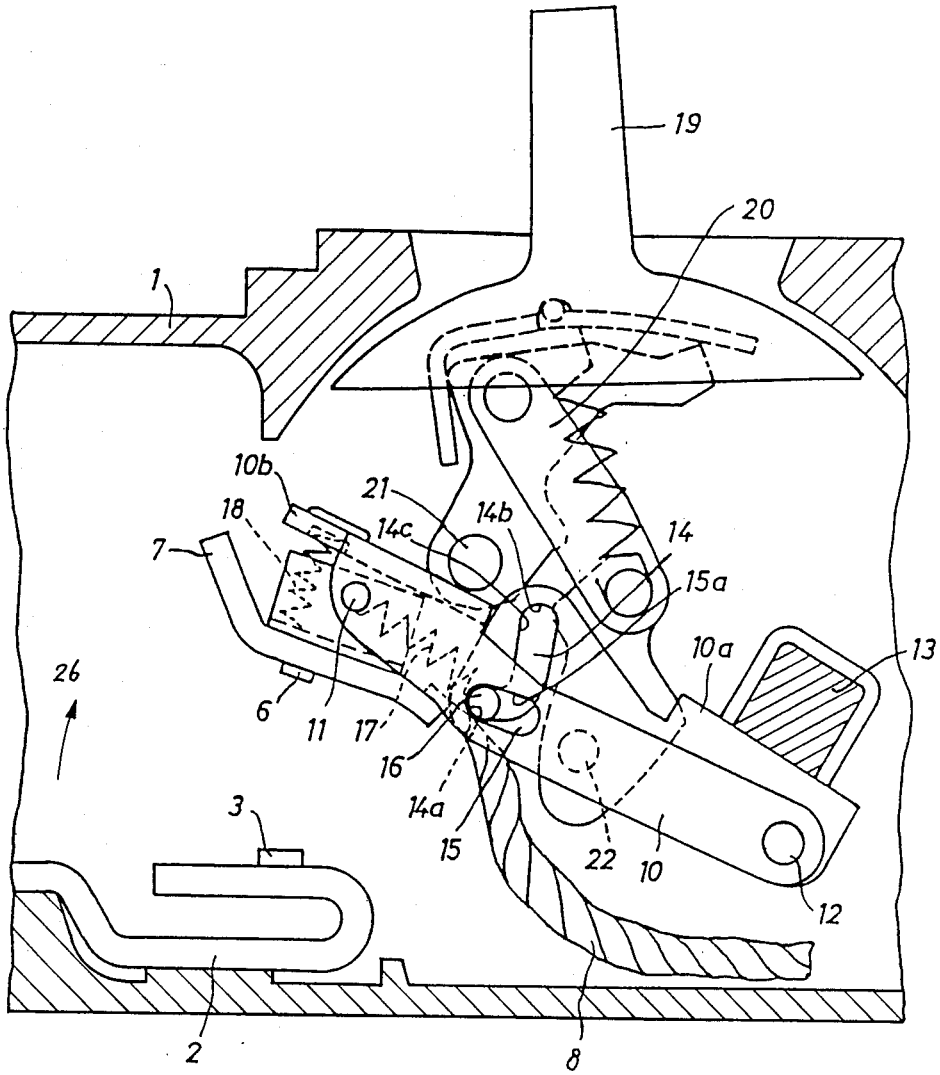
FIG. 4 (Prior Art)
FIG. 4 is a side view showing the main portion of the circuit breaker of FIG. 1 in trip state.
Figure 5:
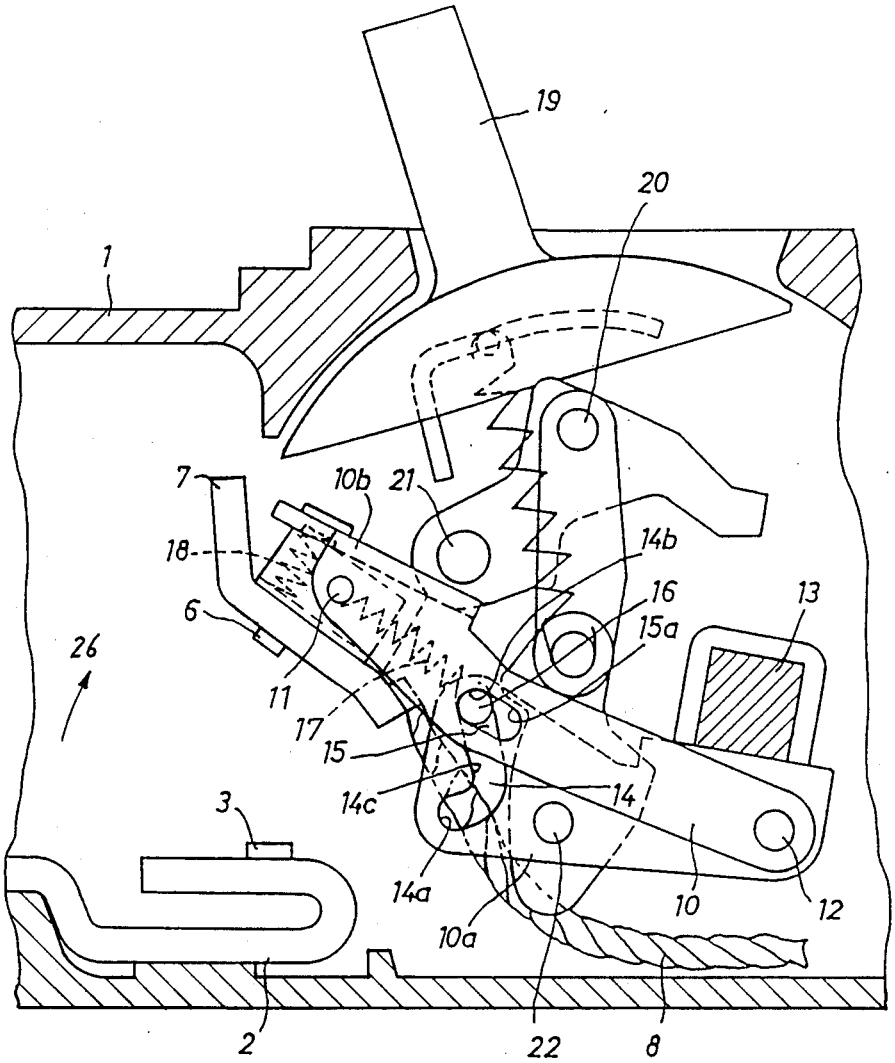
FIG.5 (Prior Art)
FIG. 5 is a side view showing the main portion of the circuit breaker of FIG. 1 in a state such that an upper contact is separated from a lower contact by a magnetic force being generated between a lower contact arm and a first upper contact arm.
Figure 6:
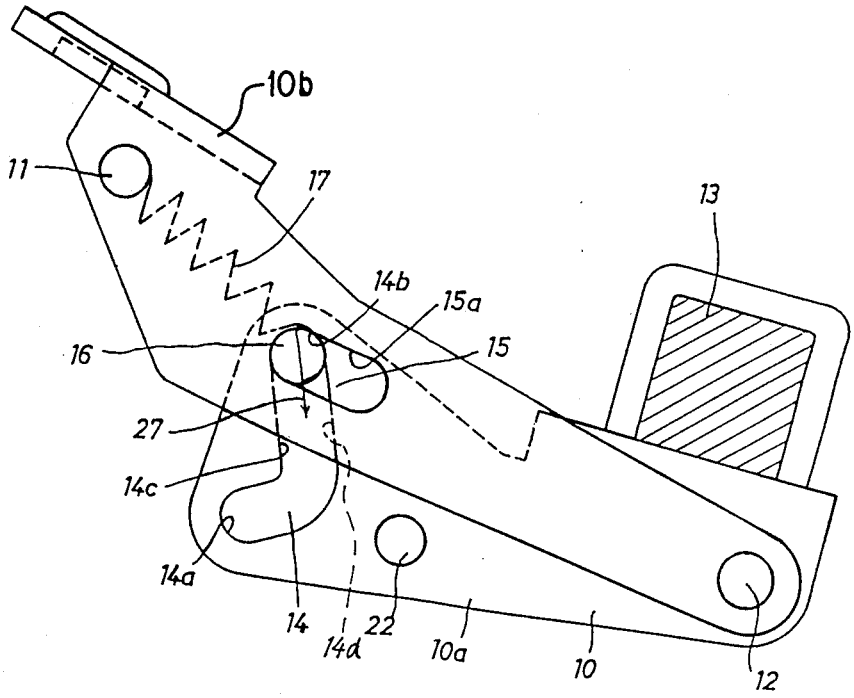
FIG. 6 (Prior Art)
FIG. 6 is a side view of a second upper contact arm and a third upper contact arm to illustrate the action of a pin 16.
Figure 7:
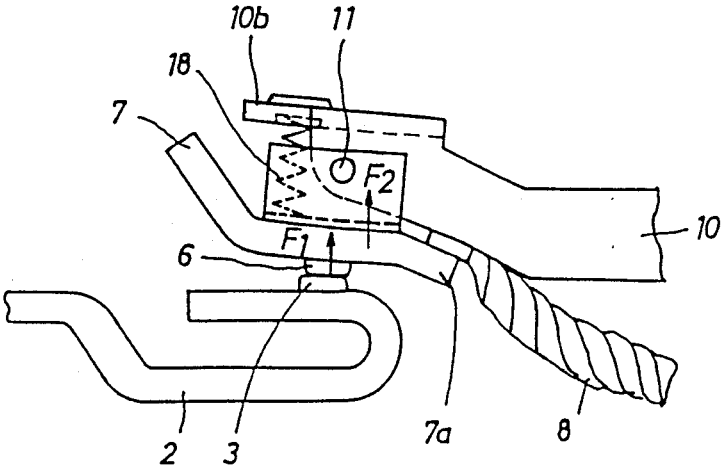
FIG.7 (Prior Art)
FIG. 7 is a schematic side view of the lower contact arm and the first upper contact arm to illustrate a magnetic force being generated by a current flowing between the lower contact arm and the first upper contact arm.
Figure 8:
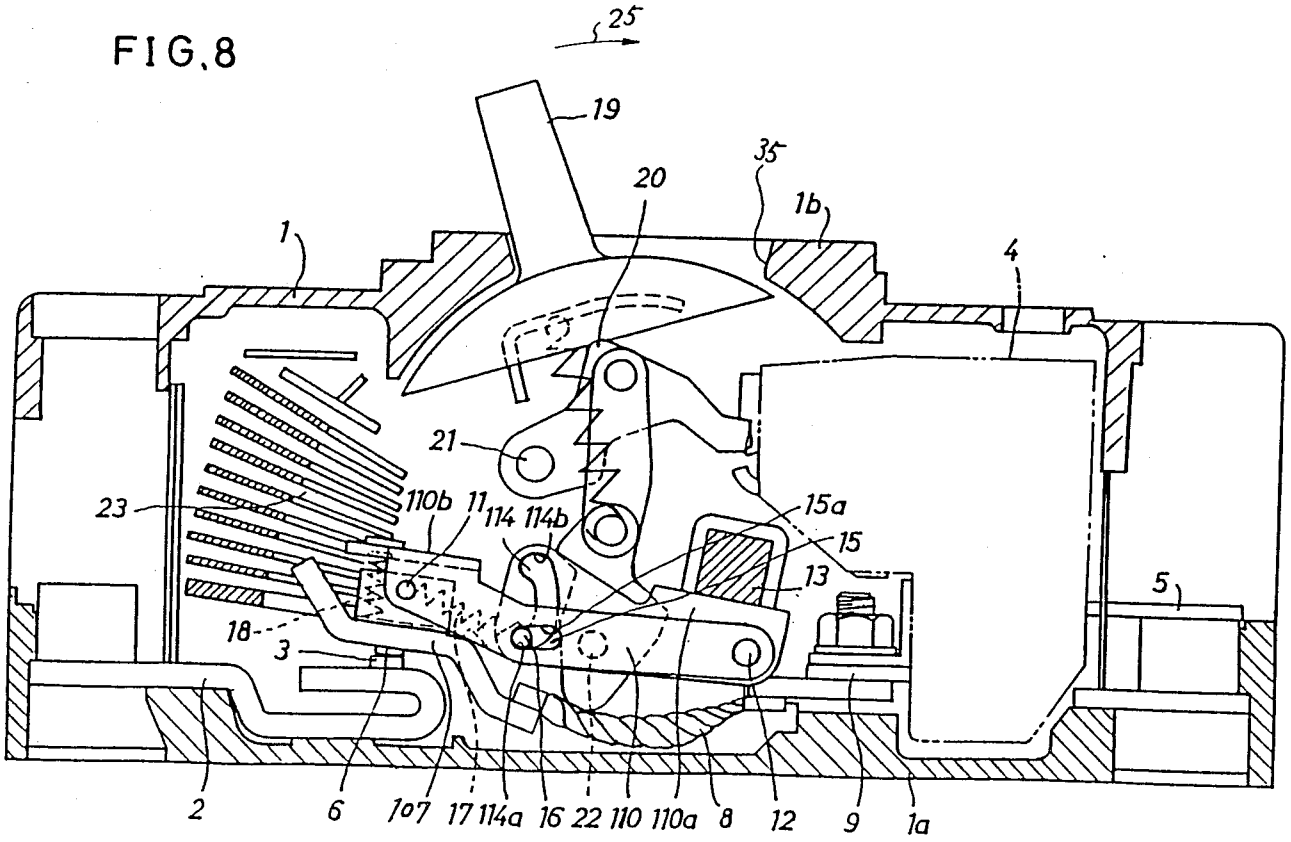
FIG. 8 is a side sectional view of a circuit breaker in accordance with a first embodiment the present invention.

FIG. 8 shows a side sectional view of a circuit breaker of a first embodiment in accordance with the present invention. Referring to FIG. 8, a molded insulating housing 1 enclosing the circuit breaker is composed of a base 1*a* and a cover 1*b*. A lower or stationary contact arm 2 is mounted on the base 1*a*. A lower contact 3 is fixed on the lower contact arm 2. An upper contact 6 is fixed on a upper contact arm 107. The upper contact arm 107 has a step-shaped or extended Z-shaped connecting portion 107*a* and is pivotally mounted to a first contact arm 110 by a pin 11. The first contact arm 110 pivots about a pin 12. An automatic trip mechanism 4 is disposed at a right portion of the housing 1, and a connecting member 5 to the automatic trip mechanism 4 is disposed on the right end of the housing 1, and another connecting member 9 from the automatic trip mechanism 4 is disposed on a lower portion thereof. The upper contact arm 107 and the connecting member 9 are connected by a flexible wire 8 at the connecting portion 107*a*. The first arm 110 is provided with an oblong aperture 15 with rounded ends, and its major axis is lengthwise of the first arm 110 on a center part thereof. A second contact arm 110*a* also pivots about the pin 12 and is provided with a flattened U-shaped aperture 114 on the left portion thereof. A pin 16 is inserted in both the flattened U-shaped aperture 114 and the oblong aperture 15, and the width of the flattened U-shaped aperture 114 is made to be larger than the diameter of the pin 16. An extension spring 17 is connected between the pins 11 and 16. A compression spring 18 is provided between the upper contact arm 107 and an end portion 110*b* of the first arm 110.

Three sets of the mechanism which are composed by the lower contact arm 2, the upper contact arm 107 and the first contact arm 110 are provided in a vertical direction of the drawing for three phase electric lines. The respective second arms 110*a* are linked by a crossbar 13. When the second arm 110*a* in the center portion is driven by an operation mechanism 20 which is operated by an operation handle 19, other second arms 110*a* are driven through the crossbar 13. An extinguishing device 23 for extinguishing electric arc being produced between the lower contact 3 and the upper contact 6 in the opening process is provided on a left portion of the housing 1.

Figure 9:
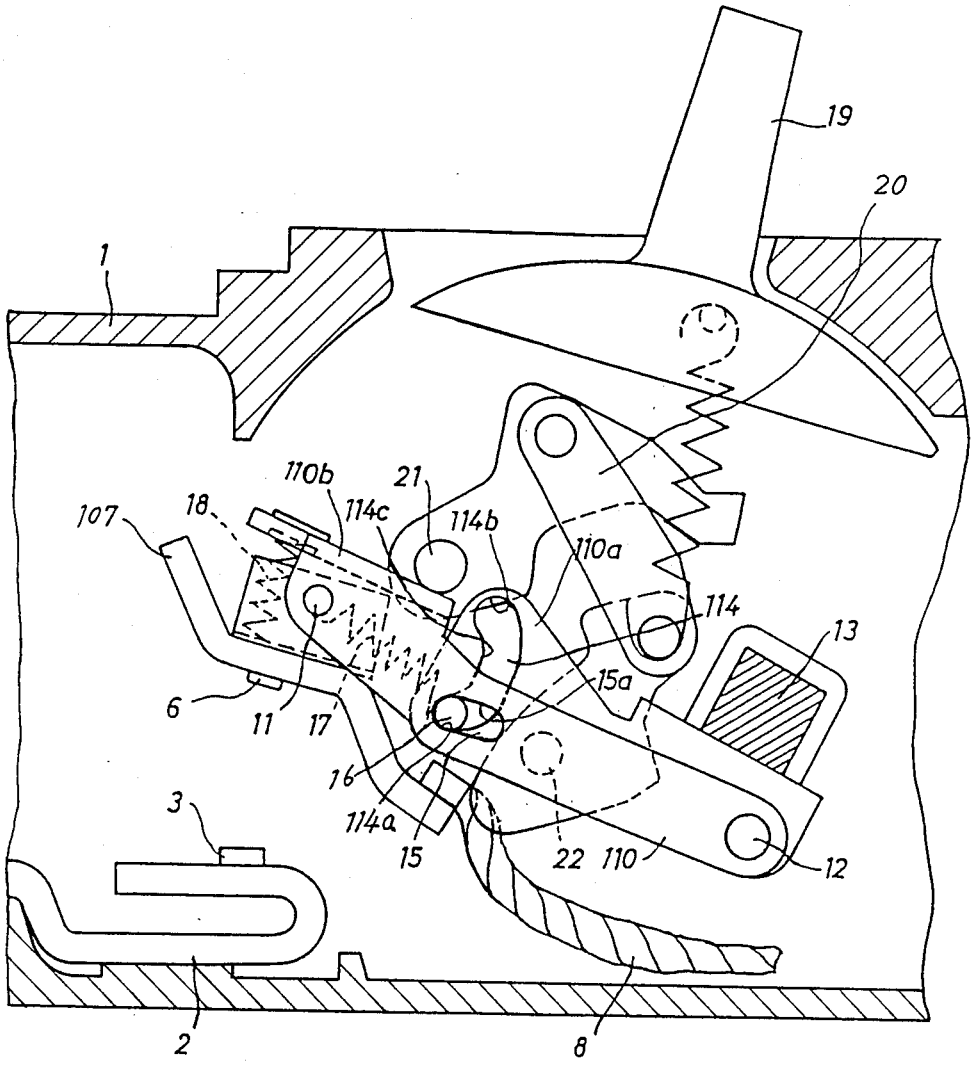
FIG. 9 is a detailed side view of a second upper contact arm and a third upper contact arm in open state of the embodiment of FIG. 8.

The operation of the circuit breaker is elucidated hereinafter. The circuit breaker is closed as shown in FIG. 8, and a current flows through the connecting member 5, the automatic trip mechanism 4, the connecting member 9, the flexible wire 8, the upper contact arm 107, the upper contact 6, the lower contact 3 and the lower contact arm 2. When the operation handle 19 is moved to the direction as shown by an arrow 25, the second arm 110*a* is lifted up by the operation mechanism 20 which is linked by a pin 22. Consequently, the first arm 110 and the upper contact arm 107 are lifted up by the pin 16 which is inserted in both the flattened U-shaped apertures 114 and the oblong aperture 15, and the upper contact 6 is separated from the lower contact 3 as shown in FIG. 9. In the above-mentioned operation, the first arm 110 is lifted up by the pin 16 which is pulled at inner wall 114*a* of the flattened U-shaped aperture 114. Then, the first arm 110 touches to a stopper pin 21 at an end portion 110*b* and its movement is limited.

Figure 10:
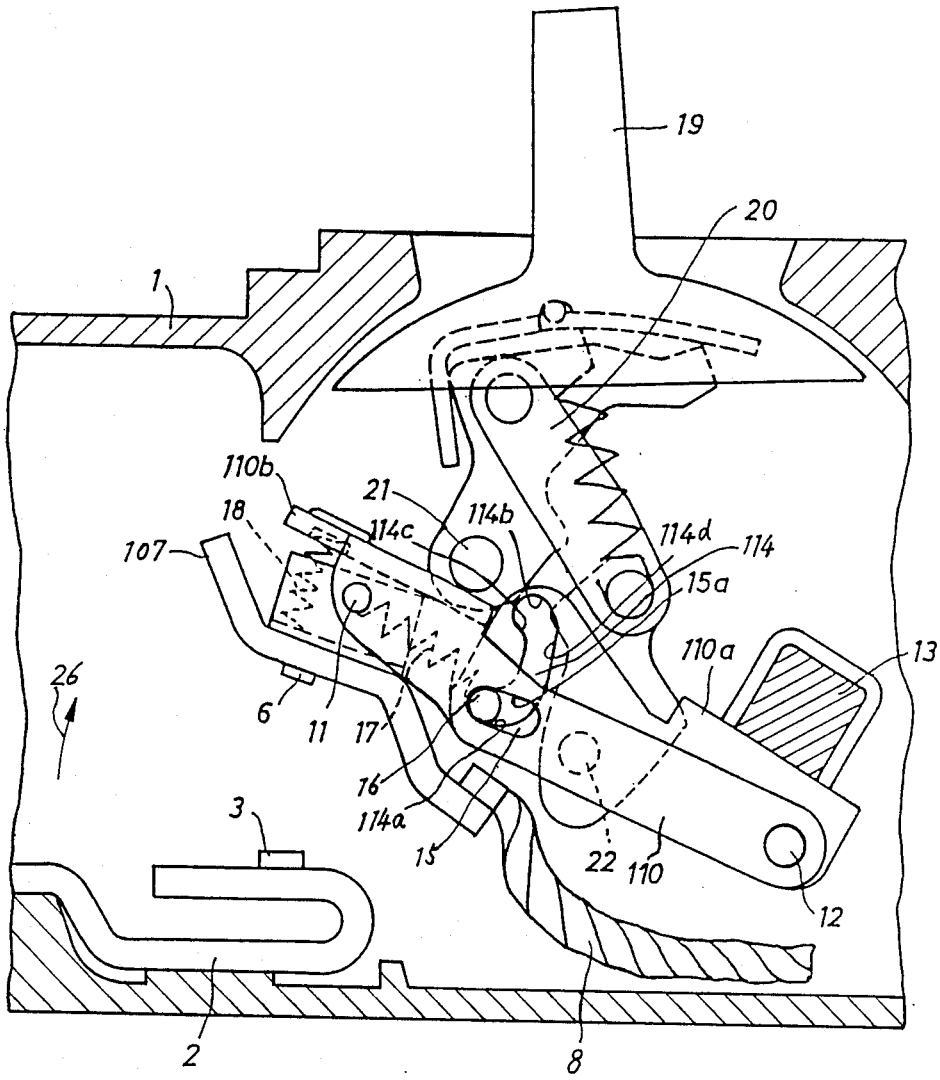
FIG. 10 is a detailed side view of the second upper contact arm and the third upper contact arm showing action of the second upper contact arm in trip state of the embodiment of FIG. 8.

When an overload current flows through the circuit breaker, the automatic trip mechanism 4 drives the operation mechanism 20 and the second arm 110*a*, the first arm 110 and the upper contact arm 107 are lifted up as shown in FIG. 10. As a result, the upper contact 6 is separated from the lower contact 3. This state of the circuit breaker is called a "trip state". In the above-mentioned operation, the pin 16 is in a lower round end 114*a* of the flattened U-shaped aperture 114, and the first arm 110 is lifted up with the second arm 110*a* by the pin 16. Then, the moving of the first arm 110 is interrupted by the pin 21.

Figure 11:
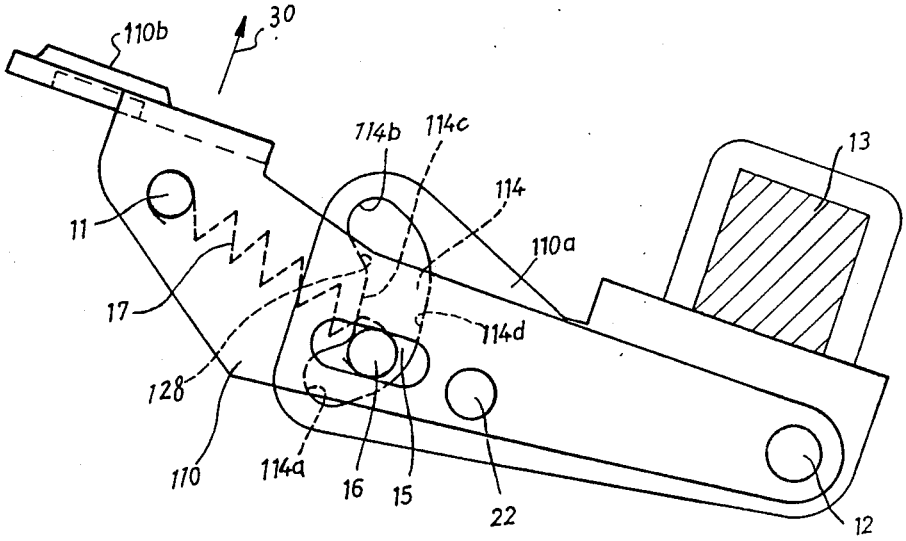
FIG. 11 and FIG. 12 are detailed side views of the second upper contact arm and the third upper contact arm showing action of the pin of the embodiment of FIG. 8.
Figure 12:
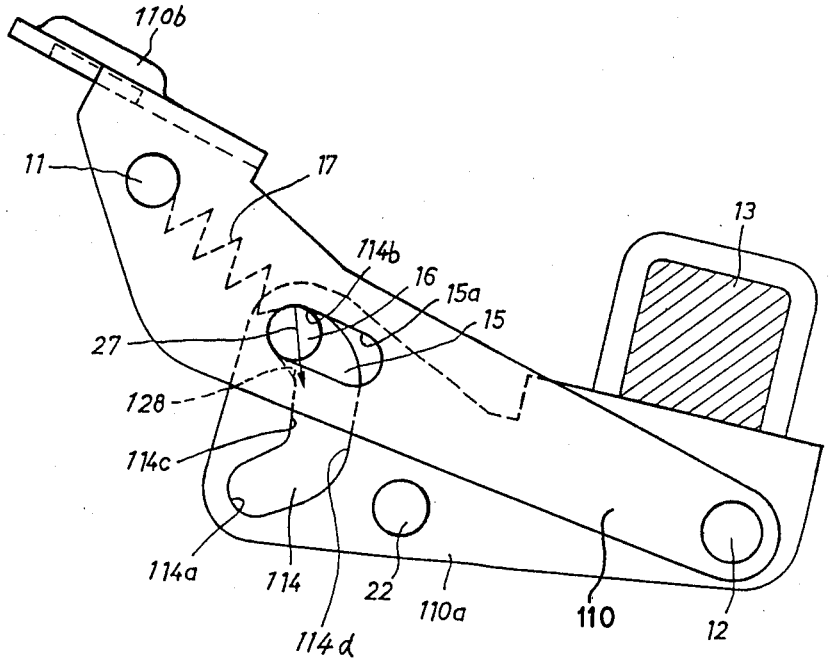

When a large current such as a shortcircuit current flows in the circuit breaker, a large magnetic force is generated between the lower contact arm 2 and the upper contact arm 107 so as to lift up the upper contact arm 107. The first arm 110 rotates in a direction as shown by the arrow 30 and pushes upward the pin 16 at the inner wall of the oblong aperture 15 as shown in FIG. 11. Consequently, the pin 16 escapes from the lower round end 114*a*, and runs upward along the flattened U-shaped aperture 114. Finally the pin 16 reaches to the upper round end 114*b* of the flattened U-shaped aperture 114 as shown in FIG. 12. As a result, the upper contact arm 107 and the first arm 110 move to the upper position, and only the second arm 110*a* stays at the lower position, since the operation mechanism 20 is not operated. After arrival of the pin 16 on the upper round end 114*b*, the pin 16 rebounds and tends to come back to the direction as shown by the arrow 27 in FIG. 12. However, the action of the pin 16 is interrupted by an inner wall 128 of the flattened U-shaped aperture 114 because the inner wall 128 is not in parallel with a direction shown by the arrow 27. Therefore, the downward movement of the first arm 110 after arrival on the upper position is prevented. The strength of the extension spring 17 is adjusted so that the pin 16 removes from the lower round end 114*a* of the flattened U-shaped aperture 114 when a predetermined current flows. In the above-mentioned operation, moving of the first arm 110 is interrupted by the upper round end 114*b* of the flattened U-shaped aperture 114.

In the embodiment, since the step-shaped connecting portion 107*a* is long and is disposed adjacent to the lower contact arm 2, the strength of the magnetic force being generated between them increases, and repulsion between them is large. Hence, action of the upper contact arm 107 is fast and the current limiting characteristic in shortcircuit is improved.

Furthermore, electric arc which is produced between the lower contact 3 and the upper contact 6 is rapidly blown to the extinguishing device 23 by the strong magnetic force. Consequently, adhering of melted substances on an inner wall 114*b* of the flattened U-shaped aperture 114 due to electric arc is reduced. Moreover, in the embodiment, adhering of the melted substances on the inner wall 114*d* does not obstruct travelling of the pin 16 because the width of the flattened U-shaped aperture 114 is made larger than the diameter of the pin 16 as shown in FIG. 11.

Figure 13:
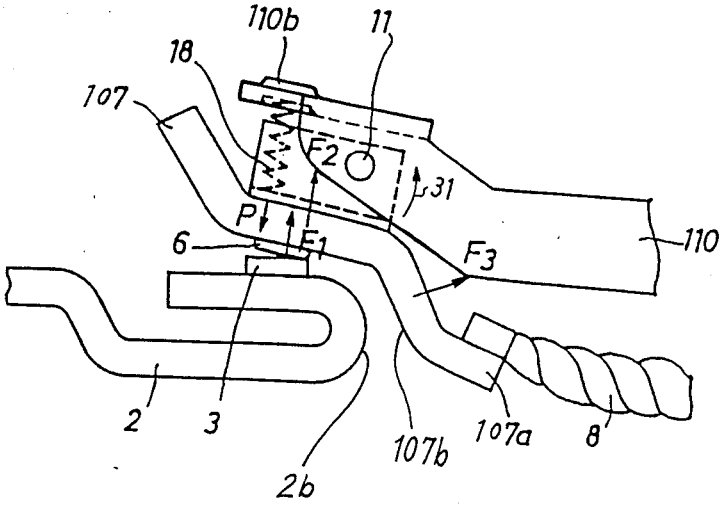
FIG. 13 is a schematic side view of a lower contact arm, a first upper contact arm and the second upper contact arm showing relation between a fulcrum of the first upper contact arm and a magnetic force being generated between the lower contact arm and the first upper contact arm.

Furthermore, in the embodiment, the pin 11 is disposed at a position which is shifted rightward from the upper contact 6 as shown in FIG. 13. Also, an intermediate part 107*b* of connecting portion 107*a* is formed to approach along a curved part 2*b* of lower contact arm 2 when the upper contact 6 makes contact with lower contact 3. Therefore, when a current flows through the upper contact arm 107, a torque as shown by an arrow 31 is generated by the repulsion between the lower contact arm 2 and the upper contact arm 107 as shown by an arrow $F_3$. Since the repulsion as shown by the arrow $F_3$ is very much larger than sum of repulsions as shown by arrows $F_1$ and $F_2$ in proximity of the upper contact 6, the upper contact 6 is sufficiently pressed to the lower contact 3. As a result, the maximum value of the current wherein the upper contact 6 begins to detach from the lower contact 3 by the repulsions increases, and stable operation of the circuit breaker is realized. The pin 11 is preferably positioned in the range from a point between the upper contact 6 and the connecting portion 107*a* to a position which is near or to the connecting portion 107*a* a distance which is equal to a diameter of the upper contact 6 from the center of the upper contact 6.

After separation of the upper contact 6 from the lower contact 3, the automatic trip mechanism 4 drives the operation mechanism 20, and the second arm 110*a* is lifted up. Hence, the pin 16 relatively falls again in the lower round end 114*a* of the flattened U-shaped aperture 114 as shown in FIG. 10. The above-mentioned operation is called a "reset" of the first arm 110.

Figure 14:
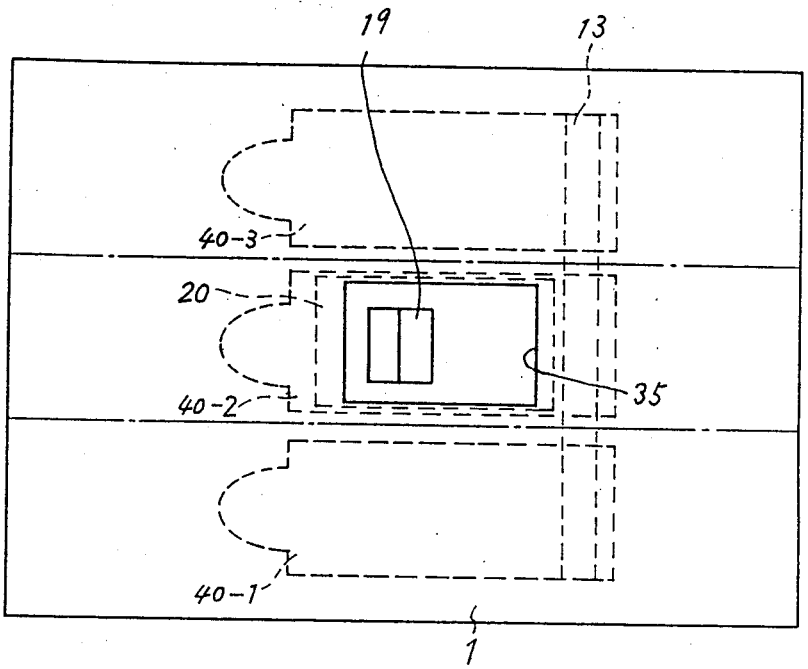
FIG. 14 is a plan view of a circuit breaker according to a preferred embodiment of this invention.
Figure 15:
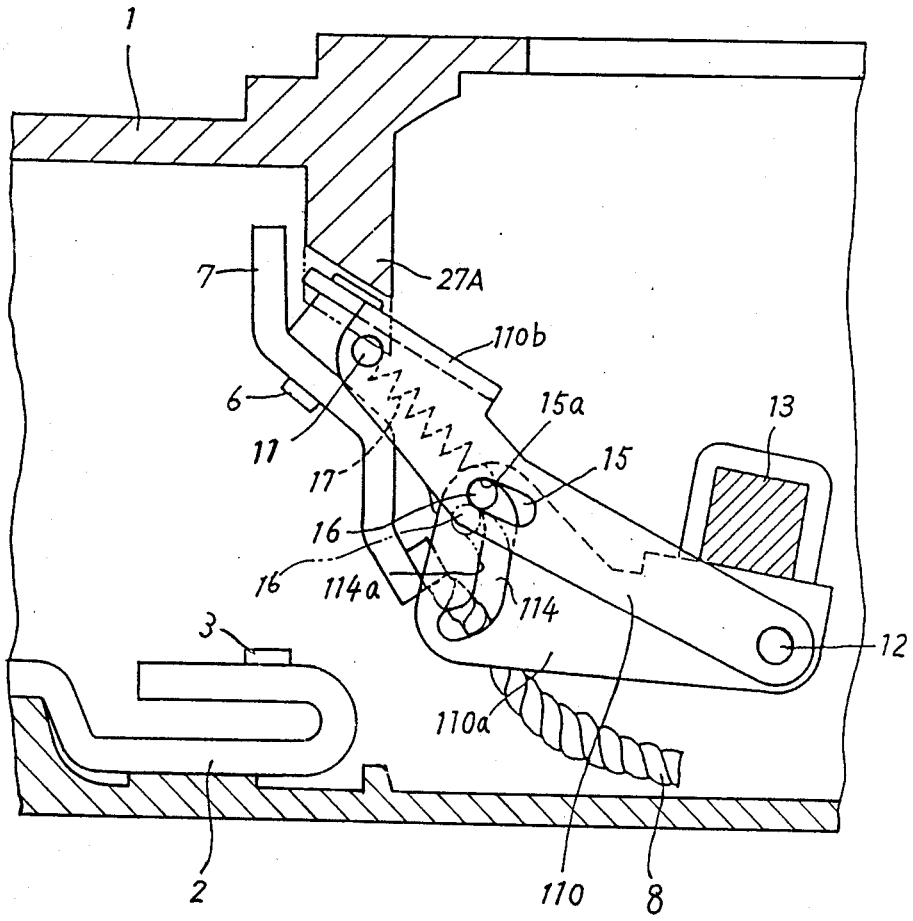
FIG. 15 is a side sectional view of the circuit breaker showing the second upper contact arm and the third upper contact arm according to a second embodiment of this invention.

Another embodiment in accordance with the present invention is elucidated referring to FIG. 14 and FIG. 15. The circuit breaker for practical use has three sets of contact mechanisms 40-1, 40-2 and 40-3 comprising the lower contact arm 2, the upper contact arm 107, the first arm 110 and the second arm 110*a*, as shown in FIG. 14 which is a plan view of the circuit breaker. The three contact mechanisms 40-1, 40-2 and 40-3 are parallelly arranged on the housing 1, and are connected by the crossbar 13 at the respective second arm 110*a*. The respective contact mechanisms 40-1, 40-2 and 40-3 correspond to three phase electric lines. The operation mechanism 20 is provided for only the central contact mechanism 40-2, and an operation handle 19 is protruded from an opening 35. Therefore, upper parts of the contact mechanisms 40-1 and 40-3 are left as open spaces.

In the embodiment, as shown in FIG. 15, the height of the flattened U-shaped aperture 114 of the second arm 110*a* of the contact mechanisms 40-1 and 40-3 are made to be higher than that of the central contact mechanism 40-2. In FIG. 15, flattened U-shaped aperture 114 of the second upper contact arm 110*a* of the central contact mechanism 40-2 is shown by a dotted line and that of the contact mechanisms 40-1 and 40-3 are shown by solid lines. Hence, the respective first arms 110 of each of the contact mechanisms 40-1 and 40-3 are allowed to rotate a through a larger angle than the arm 110 of the central contact mechanism 40-2. A stopper 27*a* which is formed on the molded insulating housing 1 is projected downward in order to stop the end portion 110*b* of the first arm 110. A projected length of the stopper 27*a* is shorter than that of the conventional stopper illustrated by a chain line. Distances between the upper contact 6 and the lower contact 3 in the contact mechanisms 40-1 and 40-3 are larger than that of central contact mechanism 40-2, when the upper contacts 6 are disconnected from the respective lower contacts 3. As a result, the interrupting characteristic of the circuit breaker is improved.

What is claimed is

1. A circuit breaker utilizing magnetic force for opening a circuit, comprising:

a stationary contact arm having a first contact;

a movable contact arm having a second contact for contacting the first contact;

a first arm mounting pivotally said movable contact arm, being provided with an oblong aperture on a central portion thereof, and mounted pivotally;

a second arm having a flattened U-shaped aperture which is terminated with a substantially indented part on one end portion and mounted pivotally at the other end;

a pin inserted to slidably engage in said oblong aperture and the flattened U-shaped aperture;

a spring for biasing said pin;

operation means for moving said second arm in operation of the circuit breaker, wherein an indent direction of said indented part is substantially different from a direction in which said pin will seek to move in rebound from an end of said U-shaped aperture.

2. A circuit breaker utilizing magnetic force for opening a circuit in accordance with claim 1, wherein:

said circuit breaker has a plurality of lines carrying electric current at respectively different phases, each line having a separate contact mechanism containing one each of said stationary contact arm, movable contact arm, first and second arms, pin and spring formed and coacting as hitherto described and disposed to operate in parallel;

said operation means being provided on only one selected electric line of said multi-phase circuit breaker; and the height of said U-shaped aperture of the second arm which is provided in all electric lines other than said selected line is formed to be higher in an opening direction of the corresponding first arm than that of the coacting second arm which is provided in said selected electric line.

3. A circuit breaker utilizing magnetic force for opening a circuit in accordance with claim 1, wherein:

said pin slides in said U-shaped aperture on a convex side inner wall which is disposed opposite to a concave side inner wall facing the same and to an electric arc to be produced between said first contact and said second contact when said circuit breaker operates; and said pin is biased by said spring, thereby making a gap between said pin and said concave side inner wall, said gap being larger than a thickness of any substance melted from said first and second contacts and which adheres on said concave side inner wall at the time of breaking of contact and related electric arcing between said first and second contacts.

4. A circuit breaker utilizing magnetic force for opening a circuit, comprising:

a stationary contact arm having a first contact;

a movable contact arm having a second contact for contacting said first contact, a connecting portion which forms an extended Z-shaped configuration from a position having the second contact to an end thereof, an intermediate part between said position and said end approaching along said stationary contact arm when said second contact contacts said first contact, and a fulcrum pin;

a first arm mounted pivotally and provided with an oblong aperture on a central portion thereof, said first arm pivotally supporting said movable contact arm;

a second arm having a flattened U-shaped aperture on one end portion and mounted pivotally at the other end;

a pin inserted to slidably engage in said oblong aperture of said first arm and the flattened U-shaped aperture of said second arm;

a spring for biasing said pin; and operation means for moving said second arm in operation of the circuit breaker, wherein said intermediate part receives a first magnetic repulsion force ($F_3$) which is generated between said stationary contact arm and said movable contact arm by current flowing therethrough, said first magnetic repulsion force being larger than a second magnetic repulsion force ($F_1+F_2$) which is generated between said first contact and said second contact and which urges said second contact to detach from said first contact, thereby generating a torque around said fulcrum pin of said movable contact arm which acts to press said second contact on said first contact.

* * * * *